US006033351A

United States Patent [19]

Sizemore, III et al.

[11] Patent Number: 6,033,351

[45] Date of Patent: Mar. 7, 2000

[54] ABDOMINAL EXERCISE APPARATUS FOR USE IN A POOL

[76] Inventors: James A. Sizemore, III, 2851 37th St. N., St. Petersburg, Fla. 33713; Richard A. Tellone, 6530-1 Cape Hatteras Way, NE., St. Petersburg, Fla. 33702

[21] Appl. No.: 09/166,316

[22] Filed: Oct. 5, 1998

[51] Int. Cl.[7] ..... A63B 21/008

[52] U.S. Cl. ..... 482/111; 482/55

[58] Field of Search ..... 482/111, 55; D25/41; 182/120, 93

[56] References Cited

U.S. PATENT DOCUMENTS 4,789,152 12/1988 Guerra .
4,822,031 4/1989 Olschewski .
4,875,673 10/1989 Erickson .
4,927,138 5/1990 Ferrari .
4,941,659 7/1990 Silvestri .
5,033,735 7/1991 Erickson .
5,080,352 1/1992 Freed .

*Primary Examiner*—Richard J. Apley
*Assistant Examiner*—Lori Baker

[57] ABSTRACT

Aquatic abdominal exercise apparatus having a pair of parallel tubular arms connected together by a first connecting member mounted over a pool deck surface juxtaposed to an edge of a pool. The arms extend downwardly along a side edge of the pool and then turn inwardly to space the apparatus from the pool wall. A second connecting member connects the portion of the arms extending downwardly and a back support is mounted on the second connecting member. A pair of arm supports project outwardly from the portion of the arms extending downwardly to provide hand supports for the exerciser.

12 Claims, 4 Drawing Sheets

ABDOMINAL EXERCISE APPARATUS FOR USE IN A POOL

BACKGROUND OF THE INVENTION

1. Field of the Invention

This invention relates to exercise apparatus used in pools. More particularly, it refers to an exercise apparatus, for strengthening abdominal muscles, mounted on the edge of a pool for use by a person exercising while supported in the pool.

2. Description of the Prior Art

Exercise devices used to strengthen abdominal muscles are well known as shown by U.S. Pat. Nos. 5,080,352; 4,927,138 and 4,789,152. In addition, several different types of aquatic exercise devices are known such as shown by U.S. Pat. Nos. 4,822,031; 4,875,673; 4,941,659 and 5,033,735. None of these references combine features providing a pool side mounted apparatus adjustable for different size individuals or providing distinct design characteristics permitting an exerciser in a pool to strengthen abdominal muscles without straining back muscles.

SUMMARY OF THE INVENTION

The present invention provides a simple pool edge attachable apparatus adjustable to the size of the exerciser that permits concentrated exercise of the abdominal muscles without concurrent strain on back muscles.

The apparatus has upright extending tubular components in the shape of two parallel U-shaped members having one arm longer than the other and having at least two parallel tubular members connecting the two U-shaped members. Arm rests project outwardly from a base portion of each U-shaped member and a back support is mounted on one of the connecting tubular members. An exercising individual places his or her back against the back support and grips each arm support while raising and lowering his or her legs to exercise the abdominal muscles.

BRIEF DESCRIPTION OF THE DRAWINGS

The invention may be best understood by those having ordinary skill in the art by reference to the following detailed description when considered in connection with the accompanying drawings in which.

DETAILED DESCRIPTION OF THE INVENTION

Figure 1:
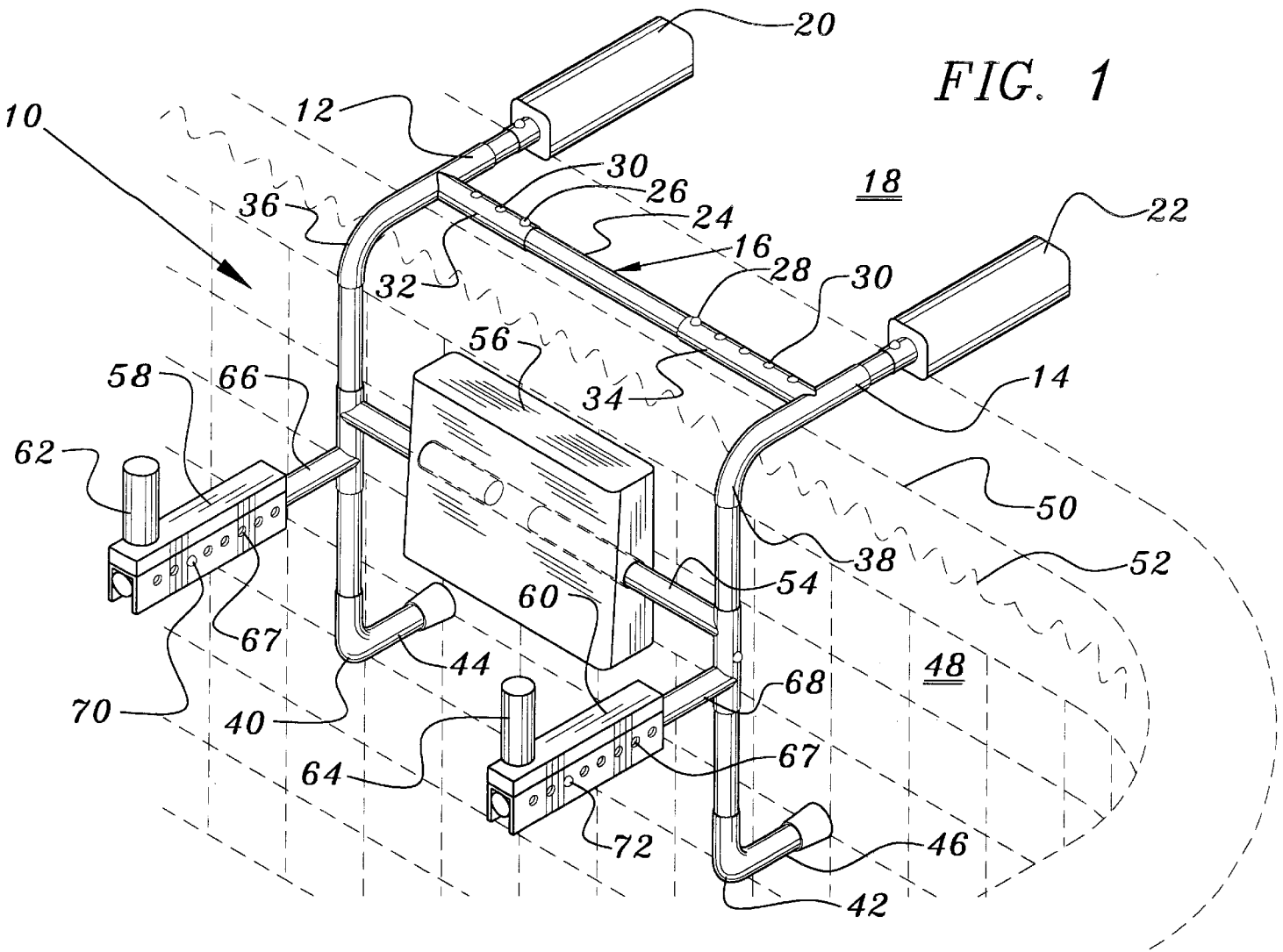
FIG. 1 is a perspective view of the abdominal exerciser of this invention mounted on the edge of a pool.
Figure 2:
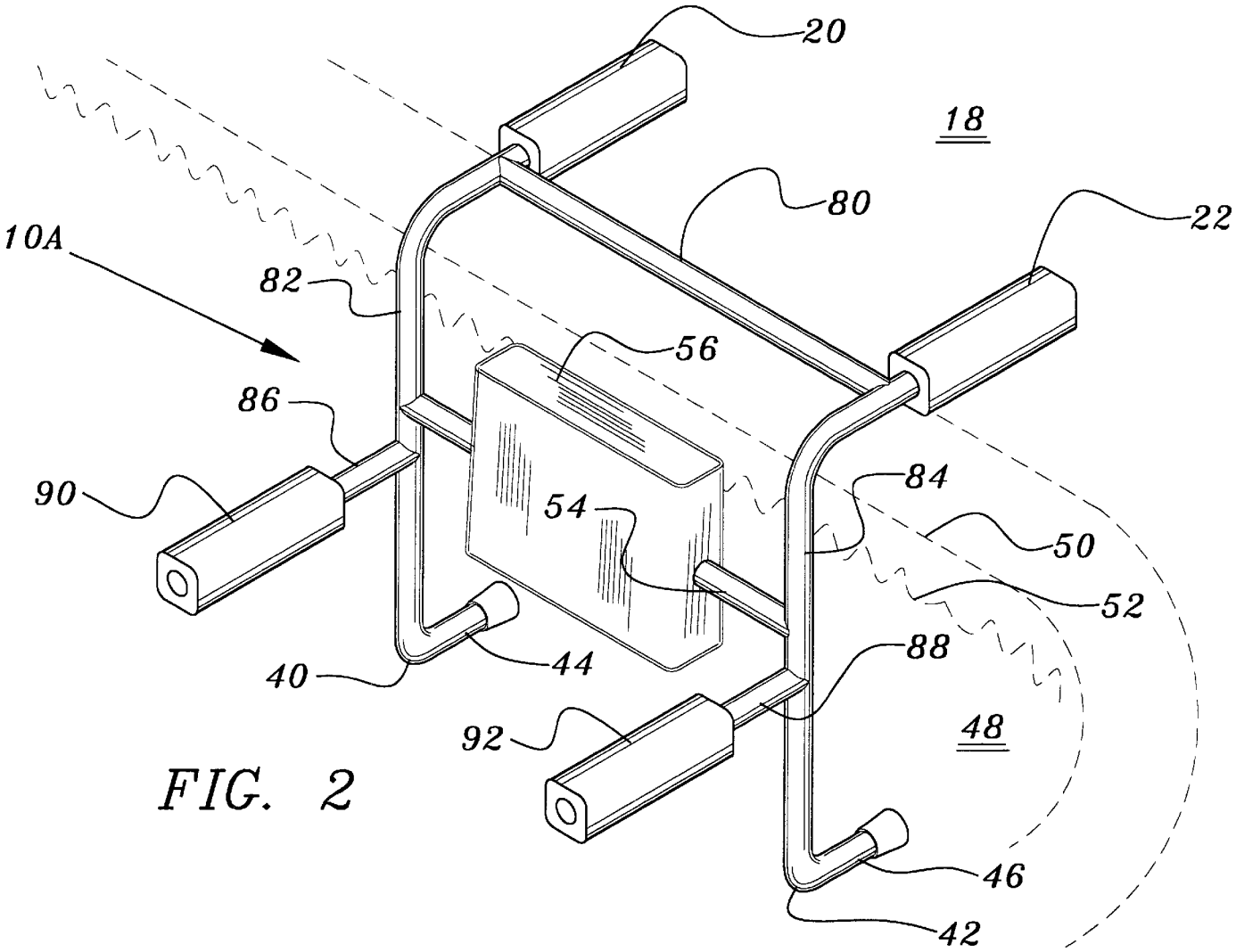
FIG. 2 is a perspective view of an alternate abdominal exerciser without adjusting mechanisms.
Figure 3:
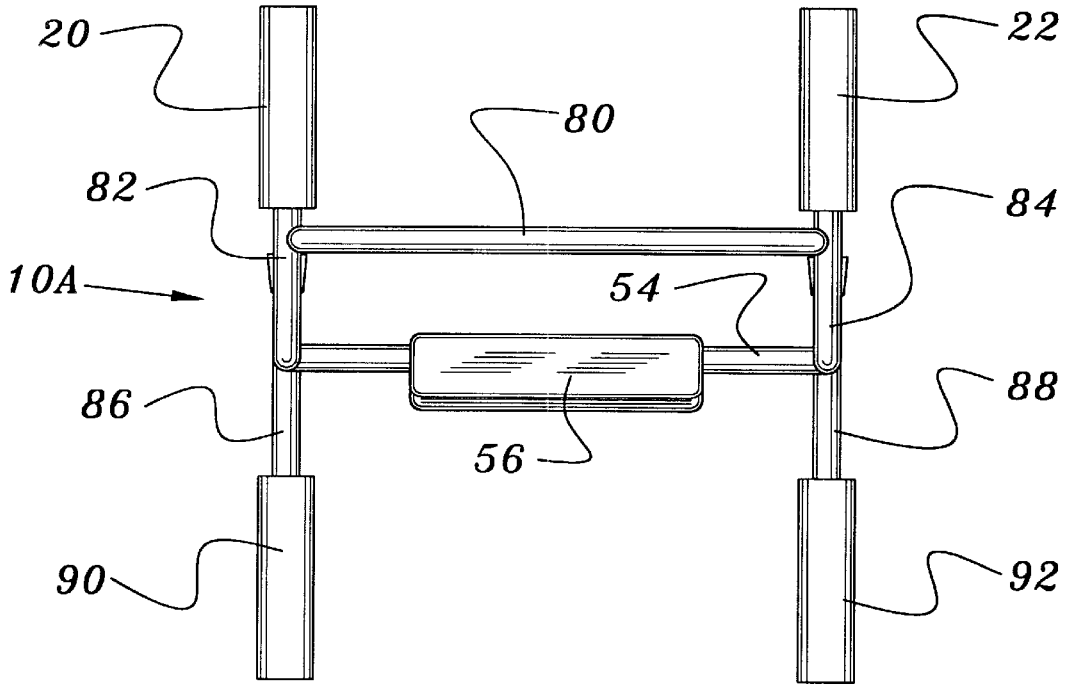
FIG. 3 is a top plan view of the abdominal exerciser of FIG. 2.
Figure 4:
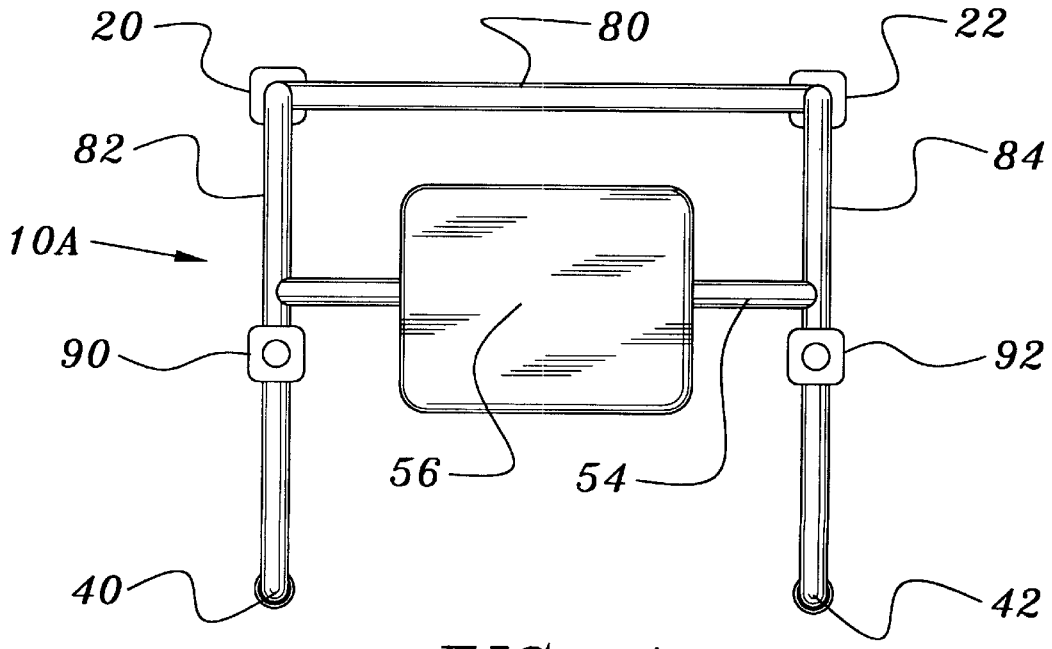
FIG. 4 is a front view of the abdominal exerciser of FIG. 2.
Figure 5:
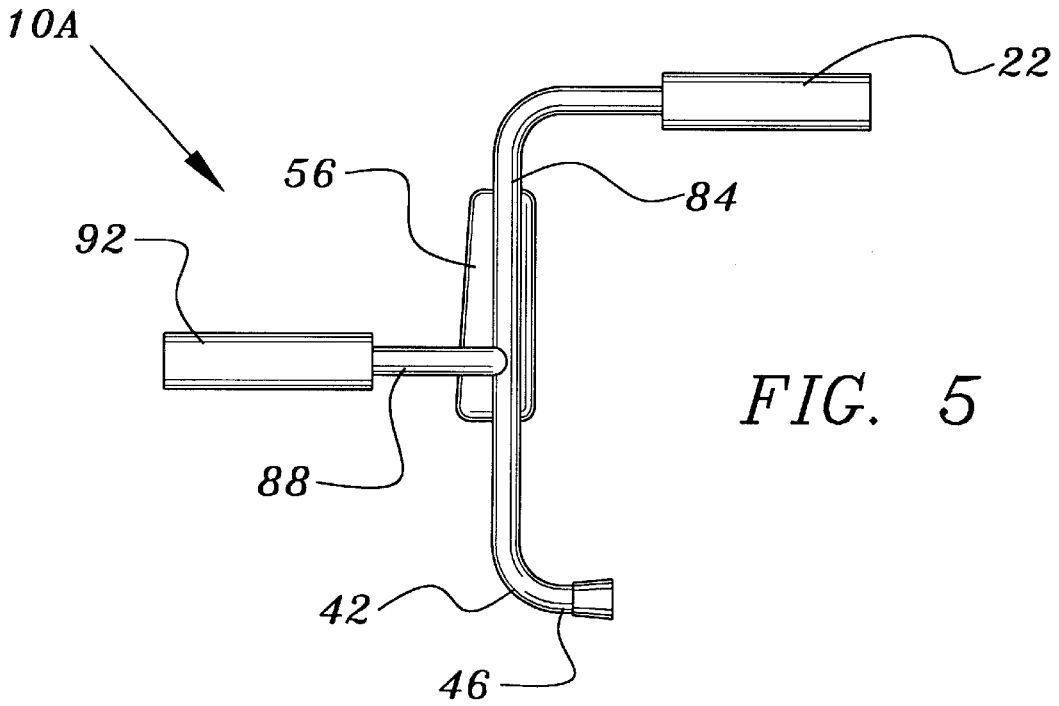
FIG. 5 is a right side view of the abdominal exerciser of FIG. 2.
Figure 6:
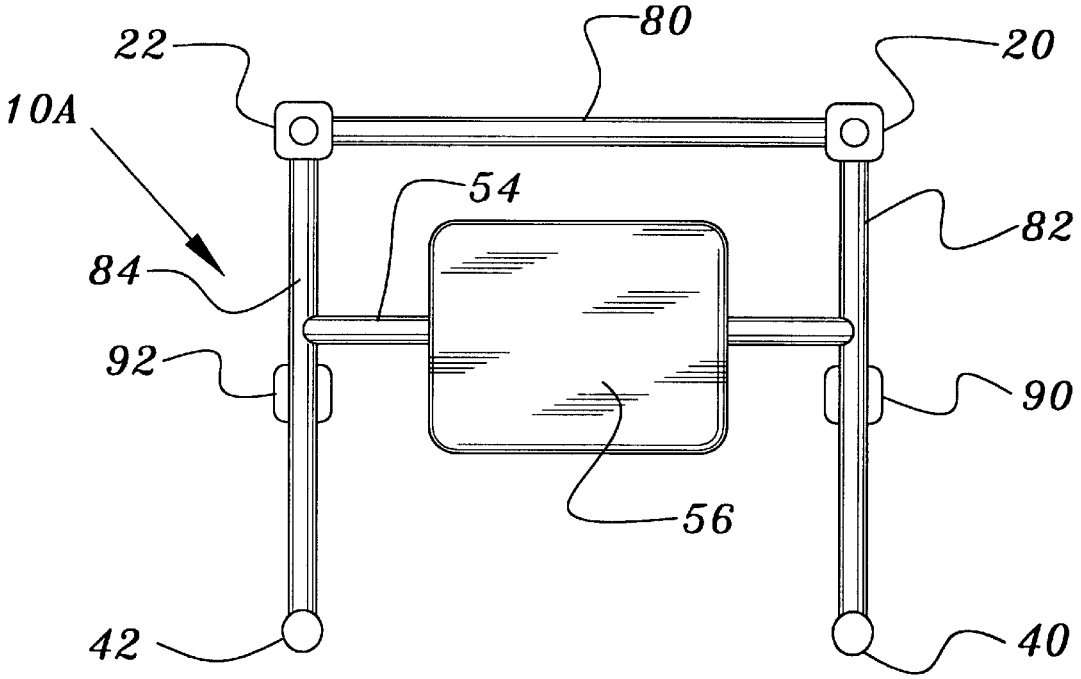
FIG. 6 is a back view of the abdominal exerciser of FIG. 2.

Throughout the following description, the same reference numerals refer to the same elements in all figures.

The abdominal aquatic exerciser 10 shown in FIG. 1 has a pair of tubular arms 12 and 14 connected together by a tubular connecting member or first horizontal connection rod 16 and mounted over a pool deck surface 18.

A plastic or rubber end member 20 and 22 are attached to arms 12 and 14 respectively to assist in engaging and adhering to the deck surface 18. A double sticky side hook and loop material attached to the underside of end members 20 and 22 keep the exerciser 10 from moving on the deck surface 18. The connecting member 16 has a central tube 24 having 26 and 28 at each end to engage holes 30 in connecting members 32 and 34 attached to arms 12 and 14, respectively.

Downwardly extending member 36 and 38 extend from arms 12 and 14, respectively. These downwardly extending members or base portions 36 and 38 curve inwardly at their bottom portion 40 and 42, respectively so that a leg 44 and 46, respectively hold the aquatic abdominal exerciser 10 away from the pool wall 48. The connector 16 is positioned near the edge 50 of the pool and the water line 52 of the pool is somewhere below edge 50.

A second connecting member or second horizontal connection rod 54 separates the downwardly extending portions 36 and 38 and a back support 56 is mounted on the second connecting member 54.

Arm 58 extends outwardly at a ninety degree angle from downwardly extending member 36 and arm 60 extends outwardly at a ninety degree angle from downwardly extending member 38. Hand grips 62 and 64 project upwardly from arm rest 58 and 60, respectively. Arm rests 58 is movable along tubular member 66 and arm rest 60 is movable along tubular member 68. A button 70 and 72 on tubular member 66 and 68, respectively engage holes 67 in the arm supports 58 and 60, respectively to position the arm supports at a comfortable distance away from downward members 36 and 38, respectively.

An exerciser submerses himself or herself below the pool level 52 with the his or her back against back support 56 and with a right hand on arm 58 and a left hand on arm 60 engaging the respective hand grips 62 and 64. After locating himself or herself in position, the arms are held taunt and legs are raised in the water to exert a force on the abdominal muscles and strengthen such muscles.

The tubular members are made out of heavy duty aluminum, high impact polymer or stainless steel and the back support 56 is made out of a polymer or soft elastomer. The pool deck supports 20 and 22, respectively can be a roughened plastic to engage the pool deck 18 and prevent slippage of the muscle exerciser 10 or can have double sided sticky hook and loop material on a bottom surface to prevent slippage.

A simpler version 10A of the aquatic abdominal exerciser is seen in FIGS. 2 through 6, wherein the exerciser is designed to accommodate the size of the person exercising and does not have adjustable means to change position of the arm support for the width of the connecting members. Hand supports are also not necessary in this device as the arm supports are sufficient.

Abdominal exerciser 10A has a connecting member 80 and downwardly extending member 82 and 84. Outwardly extending arms 86 and 88 extend outwardly at a ninety degree angle from members 82 and 84, respectively. Hand supports 90 and 92 made of a polymer or soft elastomer terminate the ends of arms 86 and 88, respectively.

Equivalent materials can be substituted for the materials employed in this invention to obtain substantially the same function to obtain substantially the same result in substantially the same way.

Having thus described the invention, what is claimed and desired to be secured by Letters Patent is:

1. A portable aquatic abdominal muscle exercise apparatus comprising:

(a) first and second parallel tubular arms connected together by a first longitudinal connecting member attached at right angles to the first and second parallel tubular arms and the first longitudinal connecting member mounted over a pool deck surface juxtaposed to an edge of the pool;

(b) an extension portion from each parallel tubular arm extending downwardly from a lowest end of each parallel tubular arm and from the edge of the pool to an inwardly extending portion abutting a side surface of the pool below a waterline, each extension from the parallel tubular arms connected together by a second longitudinal connecting member parallel to the first longitudinal connecting member but in a different plane an upper end of each parallel tubular arm terminating in an end member removably adhering to the pool deck surface;

(c) an arm support projecting outwardly from each extension portion; and (d) a back support mounted about a middle portion of the second longitudinal connecting member.

2. The portable aquatic abdominal muscle exercise apparatus according to claim 1, wherein the first longitudinal connecting member contains means for adjusting the length of the longitudinal connecting member.

3. The portable aquatic abdominal muscle exercise apparatus according to claim 1, wherein the first longitudinal connecting member has three sections, a first section attached at right angles to the first parallel tubular arm, a second section attached at right angles to the second parallel tubular arm, the first and second sections having multiple holes adapted to receive a button on a third section connecting the first and second sections together.

4. The portable aquatic abdominal muscle exercise apparatus according to claim 1, wherein the arm support projecting outwardly from each extension portion contains means for adjusting the length of the arm support.

5. The portable aquatic abdominal muscle exercise apparatus according to claim 1, wherein each arm support projecting outwardly from the extension portion has a hand support at a distal end of the arm support.

6. The portable aquatic abdominal muscle exercise apparatus according to claim 1 wherein, the upper end of the first and second parallel tubular arm over the pool deck surface contain means for preventing slippage on the deck surface.

7. A portable aquatic abdominal muscle exercise apparatus comprising:

(a) a pair of U-shaped parallel tubular members each having a first arm longer than a second arm, with a base portion of each U-shaped parallel tubular member connecting the first and second arm in a vertical direction, the first arm mounted on a pool deck surface and the second arm adapted to space the exercise apparatus from a pool vertical side surface below a water line, with the base portion substantially parallel to the pool vertical side surface;

(b) an arm rest projecting outwardly from the base portion at right angles from each base portion, and (c) a first horizontal connection rod attaching the first arms to each other and a second horizontal connection rod attaching the base portions together, the first and second horizontal connection rods being parallel but in a different vertical plane.

8. A portable aquatic abdominal muscle exerciser according to claim 7, wherein a distal portion of the first arms contain a means for preventing the arms from slipping on a pool deck.

9. A portable aquatic abdominal muscle exerciser according to claim 7 wherein, the second horizontal connection rod has a back rest mounted at about the middle of the rod.

10. A portable aquatic abdominal muscle exerciser according to claim 7 wherein, the arm rest contains a hand grip at a distal portion from the U-shaped tubular member.

11. A portable aquatic abdominal muscle exerciser according to claim 7 wherein, the first and second horizontal connection rods contain a means for extending the rods between the pair of U-shaped parallel tubular members.

12. A portable aquatic abdominal muscle exerciser according to claim 7 wherein, the arm rest projecting outwardly contains a means for extending the arm rest outwardly.

* * * * *